US007421808B2

(12) United States Patent
Baier et al.

(10) Patent No.: US 7,421,808 B2
(45) Date of Patent: Sep. 9, 2008

(54) SIMPLIFIED SHOE CONSTRUCTION WITH MIDSOLE HAVING OVERMOLDED INSERT

(75) Inventors: John L. Baier, Hampton Falls, NH (US); Christopher J. Edington, Portland, OR (US)

(73) Assignee: Converse Inc., North Andover, MA (US)

( * ) Notice: Subject to any disclaimer, the term of this patent is extended or adjusted under 35 U.S.C. 154(b) by 387 days.

(21) Appl. No.: 11/146,605

(22) Filed: Jun. 7, 2005

(65) Prior Publication Data

US 2006/0277795 A1 Dec. 14, 2006

(51) Int. Cl.
*A43B 23/00* (2006.01)
*A43B 13/38* (2006.01)

(52) U.S. Cl. ..... 36/107; 36/30 R; 36/44

(58) Field of Classification Search ..... 36/102, 36/107, 108, 30 R, 44, 76 C, 167, 171, 177
See application file for complete search history.

(56) References Cited

U.S. PATENT DOCUMENTS

| | | | | |
|---|---|---|---|---|
| 2,129,424 | A * | 9/1938 | Jay | 36/76 R |
| 2,307,416 | A * | 1/1943 | Margolin | 36/147 |
| 3,244,177 | A * | 4/1966 | Scholl | 36/154 |
| 3,983,204 | A | 9/1976 | Opinsky et al. | |
| 4,032,611 | A | 6/1977 | Fukuoka | |
| 4,246,708 | A * | 1/1981 | Gladek | 36/107 |
| 4,316,332 | A | 2/1982 | Giese et al. | |
| 4,364,188 | A | 12/1982 | Turner et al. | |
| 4,439,937 | A * | 4/1984 | Daswick | 36/107 |
| 4,561,140 | A | 12/1985 | Graham et al. | |
| 4,616,430 | A | 10/1986 | McQuiggin | |
| 4,651,444 | A | 3/1987 | Ours | |
| 4,962,593 | A * | 10/1990 | Brown | 36/44 |
| 6,041,525 | A * | 3/2000 | Kelley | 36/115 |
| 6,477,791 | B2 * | 11/2002 | Luthi et al. | 36/31 |
| 6,713,006 | B1 | 3/2004 | Redin Gorraiz | |
| 6,910,287 | B2 * | 6/2005 | Truelsen | 36/30 R |
| 7,062,865 | B1 * | 6/2006 | Nordt, III | 36/27 |
| 7,096,605 | B1 * | 8/2006 | Kozo et al. | 36/103 |

* cited by examiner

*Primary Examiner*—Ted Kavanaugh
(74) *Attorney, Agent, or Firm*—Gallop, Johnson & Neuman, L.C.; Kennth Solomon, Esq.

(57) ABSTRACT

A shoe construction employs a midsole molded of flexible, resilient material around a rigid plate, where the midsole and encapsulated plate are insertable into a separately constructed outsole and shoe upper.

21 Claims, 7 Drawing Sheets

SIMPLIFIED SHOE CONSTRUCTION WITH MIDSOLE HAVING OVERMOLDED INSERT

BACKGROUND OF THE INVENTION (1) Field of the Invention

The present invention pertains to a simple, inexpensive shoe construction of a lightweight, comfortable shoe. In particular, the present invention pertains to a shoe construction that employs a midsole molded of flexible, resilient material around a rigid plate, where the midsole and encapsulated plate are insertable into a separately constructed outsole and shoe upper.

(2) Description of the Related Art

Many different types of shoe constructions and methods of shoe construction exist in the prior art. In the construction of shoes that are primarily intended to cushion the foot and support the foot laterally, for example athletic or running shoes, the number of components in the shoe construction and the number of the construction steps can be numerous. The additional component parts used in the construction of a shoe and the additional method steps involved in the construction of the shoe add to the overall manufacturing cost of the shoe.

While many comfortable shoes have been designed, the designs of the shoes have required elaborate and expensive constructions. It follows that a shoe having a simple, inexpensive construction that is also lightweight and comfortable to wear would be very desirable.

SUMMARY OF THE INVENTION

The present invention provides a lightweight, comfortable shoe that is constructed according to a simplified and inexpensive method. The shoe is constructed of a reduced number of parts, and the method of constructing the shoe involves separately assembling two separate subassemblies that are fit with each other in producing the manufactured shoe.

The shoe of the invention has an outsole that is unitarily molded of a flexible, resilient material. The outsole is formed with a top surface and an opposite bottom surface that are separated from each other by a peripheral edge that extends around the outsole. The outsole bottom surface is formed with a tread.

An upper of flexible material is secured to the outsole. In the preferred embodiment, the material of the upper is a mesh material which enhances the lightweight and comfortable characteristics of the shoe. The upper is secured around the outsole peripheral edge and extends over the outsole top surface. An opening in the upper provides access into the shoe interior between the upper and the outsole. The upper secured to the outsole comprises a first subassembly of the shoe construction.

The shoe midsole is also unitarily molded of a flexible, resilient material. The material of the midsole is preferably more flexible and more resilient than the material of the outsole. The midsole is molded with opposite top and bottom surfaces that are separated by a peripheral edge of the midsole that extends around the midsole.

A rigid plate is encapsulated in the midsole between the midsole top and bottom surfaces. The plate is constructed of a material that is significantly more rigid than the material of the midsole. The plate extends along the length of the midsole from a heel area of the midsole, through an arch area of the midsole and ends adjacent a ball area of the midsole. The plate is thin and is curved in two mutually perpendicular directions to cup the bottom of the shoe wearer's heel and arch. The rigid material of the plate helps to control the extent of cushioning in the heel preventing the heel area of the midsole from overcompressing, and also helps stabilize the heel laterally in the shoe. The midsole and encapsulated plate comprise a second subassembly of the shoe that is inserted into the interior volume of the first subassembly and is positioned on the top surface of the outsole inside the shoe upper in completing the construction of the shoe.

The method of constructing the shoe involves molding the material of the midsole around the rigid plate to encapsulate the plate in the midsole. Employing a midsole mold having top and bottom surfaces, the mold bottom surface is provided with a plurality of projections. The rigid plate is positioned on the projections to position the plate in an area where the material of the midsole will flow over the top surface and beneath the bottom surface of the plate. Thus, the projections positively locate the rigid plate inside the material of the midsole spaced below the midsole top surface and above the midsole bottom surface.

The simplified construction of the shoe described above provides an inexpensively constructed shoe that is lightweight and comfortable to wear and provides cushioning and support for the shoe wearer's foot.

BRIEF DESCRIPTION OF THE DRAWINGS

Further features of the shoe of the invention are set forth in the following detailed description of the preferred embodiment of the shoe, and in the following drawing figures wherein.

DETAILED DESCRIPTION OF THE PREFERRED EMBODIMENT

As stated earlier, the present invention provides a lightweight, comfortable shoe that is constructed according to a simplified and inexpensive method. The shoe is constructed of a reduced number of parts, and the method of constructing the shoe involves separately assembling two separate subassemblies that are fit with each other in producing the manufactured shoe. Manufacturing the subassemblies separately simplifies the shoe construction and reduces the cost of manufacturing.

Figure 15:
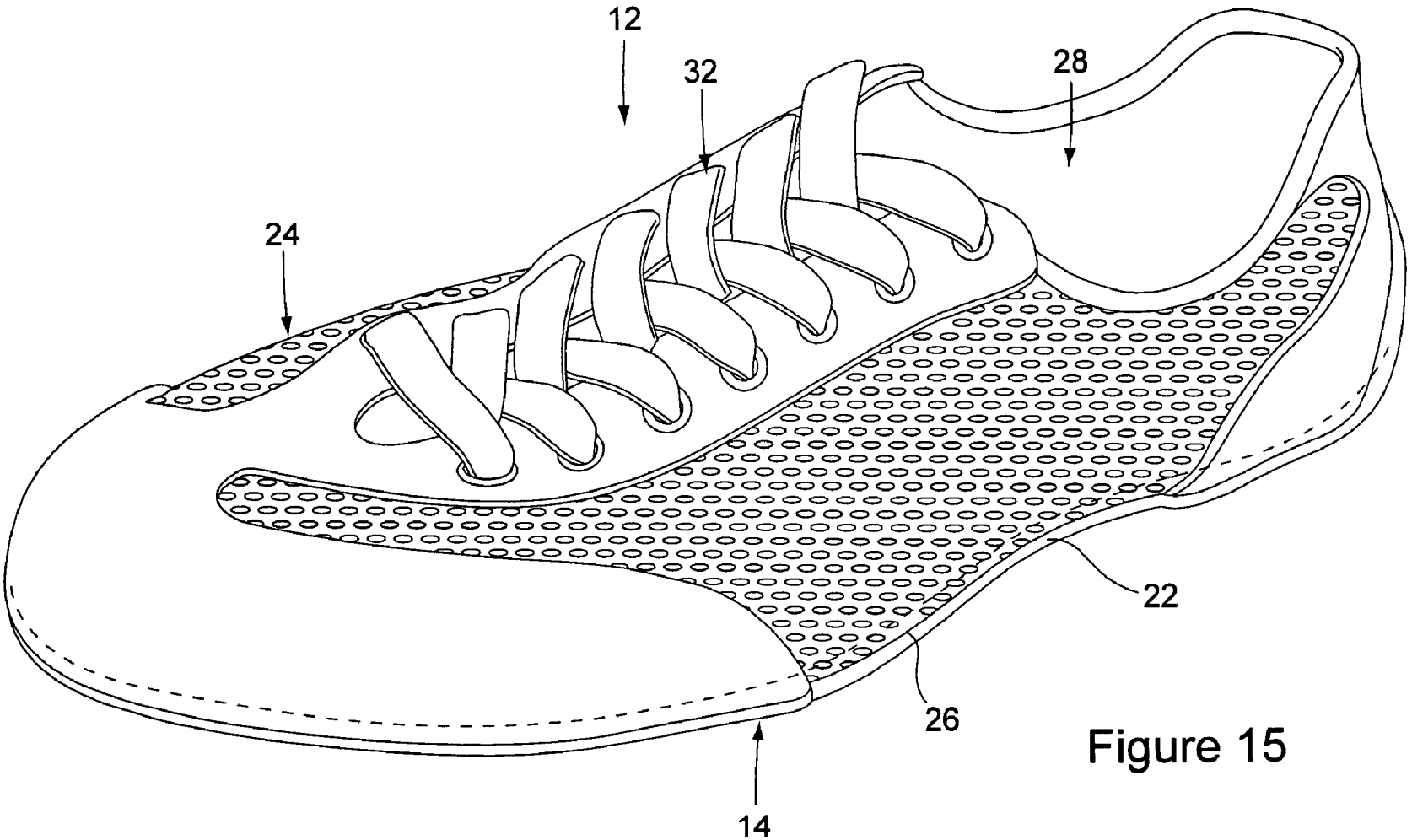

The shoe 12 of the invention includes an outsole 14, an example of which is shown in FIG. 15. The outsole 14 can have a variety of different shapes and dimensions. An important feature of the outsole 14 is that it is unitarily molded of a flexible, resilient material. Thus, the entire outsole 14 is formed of one type of material that is consistent throughout the outsole. The outsole 14 is formed with a top surface 16 and an opposite bottom surface 18 that are separated from each other by a peripheral edge 22 of the outsole. The peripheral edge 22 extends around the outsole and defines the outermost periphery of the outsole. The outsole bottom surface 18 is formed with a tread.

An upper 24 of flexible material is secured to the outsole 14. In the preferred embodiment shown in the drawing figures, the material of the upper 24 is predominantly a mesh material which enhances the lightweight and comfortable characteristics of the shoe. The upper 24 has an outer peripheral edge 26 that is secured around the outer peripheral edge 22 of the outsole. The material of the upper extends over the outsole top surface 16. The upper 24 is constructed with a conventional opening 28 that, in the embodiment shown in the drawing figures, is closed over the foot of a shoe wearer by a lacing assembly 32. The opening 28 in the upper provides access into the shoe interior enclosed between the outsole top surface 16 and the upper 24. The upper 24 secured to the outsole 14 comprises a first subassembly of the shoe construction. The interior of the shoe between the upper 24 and the outsole 14 is dimensioned to receive a second subassembly of the shoe construction to be described.

FIGS. 1-4 show the shoe midsole 34 of the present invention. The construction of the midsole 34 comprises the second subassembly of the shoe construction. The midsole 34 is molded as a single unit. The midsole 34 is unitarily molded of a flexible, resilient material that has a greater flexibility and a greater resiliency than the material of the outsole 14. The characteristics of the material of the midsole 34 are constant throughout the midsole. The midsole is molded with opposite top 36 and bottom 38 surfaces that are separated by a peripheral edge 42 of the midsole that extends completely around the midsole. The flexibility and resiliency characteristics of the midsole material are constant throughout the midsole between the top 36 and bottom 38 surfaces of the midsole and within the midsole peripheral edge 42.

Figures 1, 2, 3, 4, 5:
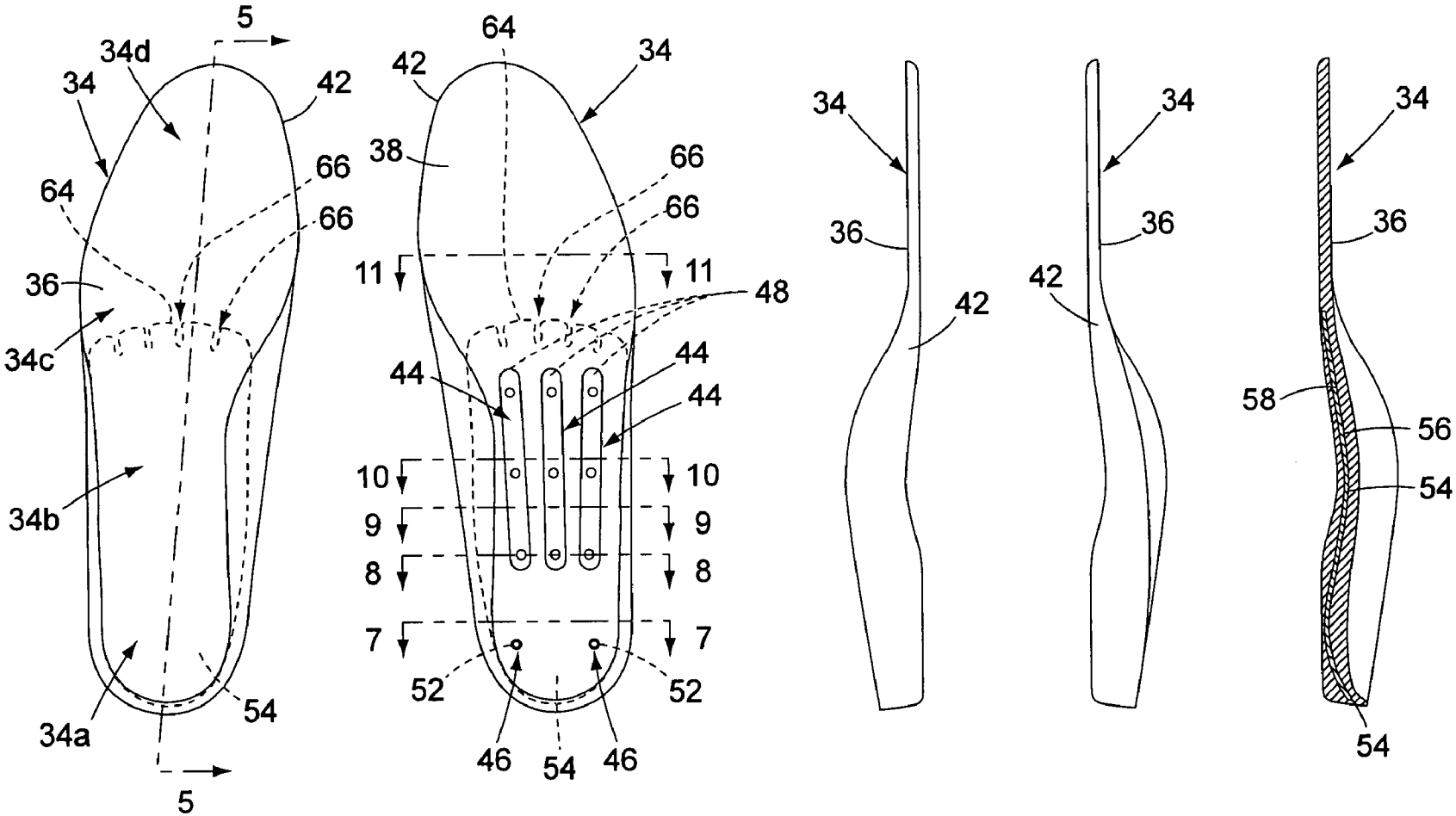
FIG. 1 is a top plan view of the shoe midsole of the invention.
FIG. 2 is a bottom plan view of the midsole.
FIG. 3 is a right side view of the midsole.
FIG. 4 is a left side view of the midsole.
FIG. 5 is a cross section of the midsole taken along the line 5-5 of FIG. 1.

The midsole 34 is formed with a plurality of locator holes 44, 46 in the midsole bottom surface 38. The locator holes 44, 46 extend from the midsole bottom surface 38 into the interior of the midsole and terminate at end surfaces 48, 52 of the respective locator holes 44, 46. As shown in FIG. 2, several of the locator holes 44 have elongate, oblong configurations. Several of the locator holes 46 also have circular configurations. The midsole bottom surface 38 has a curved configuration that substantially matches the curved configuration of the outsole top surface 16. This enables the midsole bottom surface 38 to rest flush on the outsole top surface 16 in assembling the shoe. The midsole top surface 36 is curved across the lateral width of the midsole as shown in FIGS. 7-10. The top surface is also curved along a lateral length of the midsole extending from a heel area 34*a* of the midsole, through an arch area 34*b* of the midsole, and ending at a ball area 34*c* of the midsole. The midsole ball area 34*c* and toe area 34*d* are substantially flat, as shown in FIGS. 3-5 and 11. The curved configuration of the midsole top surface 36 cups and comfortably holds the bottom of the shoe wearer's foot.

Figure 6:
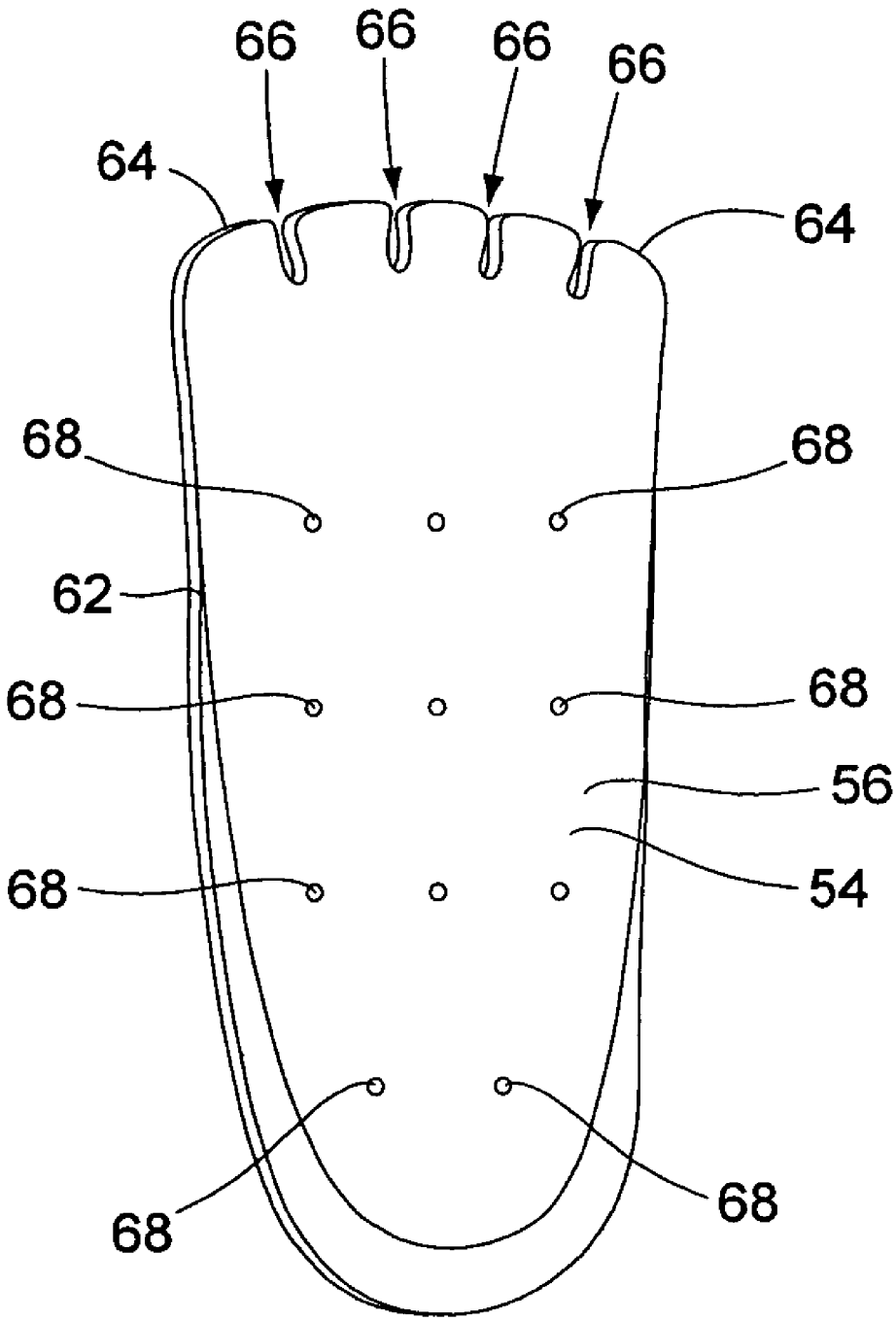
FIG. 6 is a top plan view of the rigid plate removed from the midsole.
Figure 8:
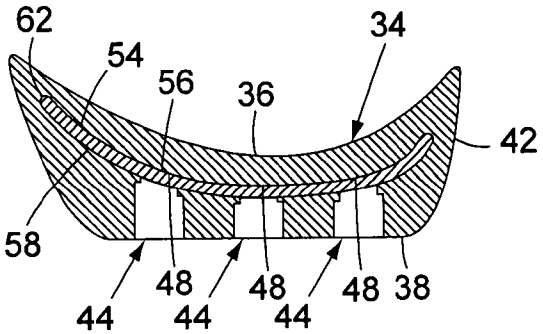
FIG. 8 is a cross section through the midsole along the line 8-8 of FIG. 2.
Figure 10:
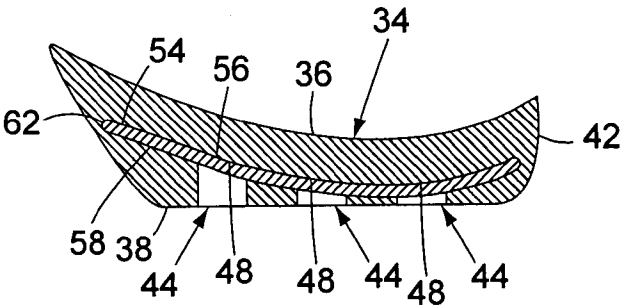
FIG. 10 is a cross section through the midsole along the line 10-10 of FIG. 2.
Figure 11:
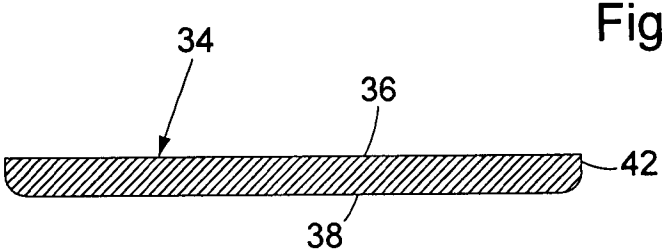
FIG. 11 is a cross section through the midsole along the line 11-11 of FIG. 2.
Figure 7:
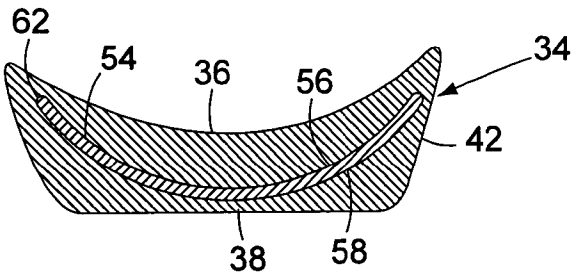
FIG. 7 is a cross section through the midsole along the line 7-7 of FIG. 2.
Figure 9:
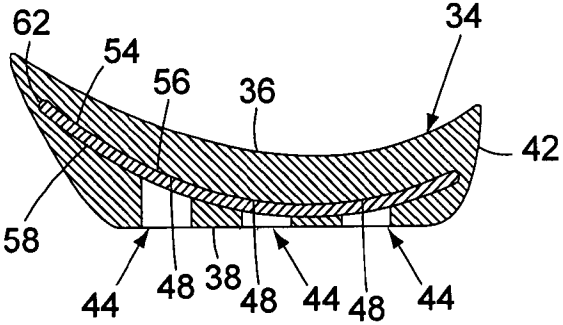
FIG. 9 is a cross section through the midsole along the line 9-9 of FIG. 2.

A rigid plate 54 is encapsulated in the midsole 34 spaced between the midsole top surface 36 and the midsole bottom surface 38. The plate 54 is shown removed from the midsole in FIG. 6. The plate 54 is constructed of a material that is significantly more rigid than the material of the midsole 34. In the preferred embodiment, the material of the plate 54 is also more rigid than the material of the outsole 14. The plate 54 has opposite top 56 and bottom 58 surfaces that are separated by a peripheral edge 62 of the plate. As seen in the cross sections of FIGS. 5 and 7-10, the plate is relatively thin between the plate top 56 and bottom 58 surfaces, and has a substantially constant thickness between the top 56 and bottom 58 surfaces. The plate 54 extends along the length of the midsole as shown in FIG. 1 from the heel area 34*a* of the midsole, through the arch area 34*b* of the midsole, and ends adjacent the ball area 34*c* of the midsole. The plate 54 is curved in the mutually perpendicular lateral and longitudinal directions to cup the bottom of the shoe wearer's heel and arch. This can best be seen in the cross sections of the midsole 34 shown in FIGS. 5 and 7-10. A forward edge portion 64 of the plate is formed with a plurality of notches 66 that extend into a forward end of the plate. The plurality of notches 66 at the forward edge portion 64 of the plate peripheral edge 62 increase the flexibility of the plate in this area of the notches. The rigid material of the plate 54 helps to control the extent of cushioning in the heel, preventing the heel area 34*a* of the midsole from over compressing, and also helps stabilize the shoe wearer's heel laterally in the shoe.

The plate 54 is provided with a plurality of pin holes 68 in the plate bottom surface 58. The pin holes 68 are utilized in the method of constructing the midsole 34, yet to be explained. The midsole 34 and encapsulated plate 54 comprise the second subassembly of the shoe that is inserted into the interior volume of the first subassembly and is positioned on the outsole top surface 16 inside the shoe upper 24 in completing the construction of the shoe.

Figure 12:
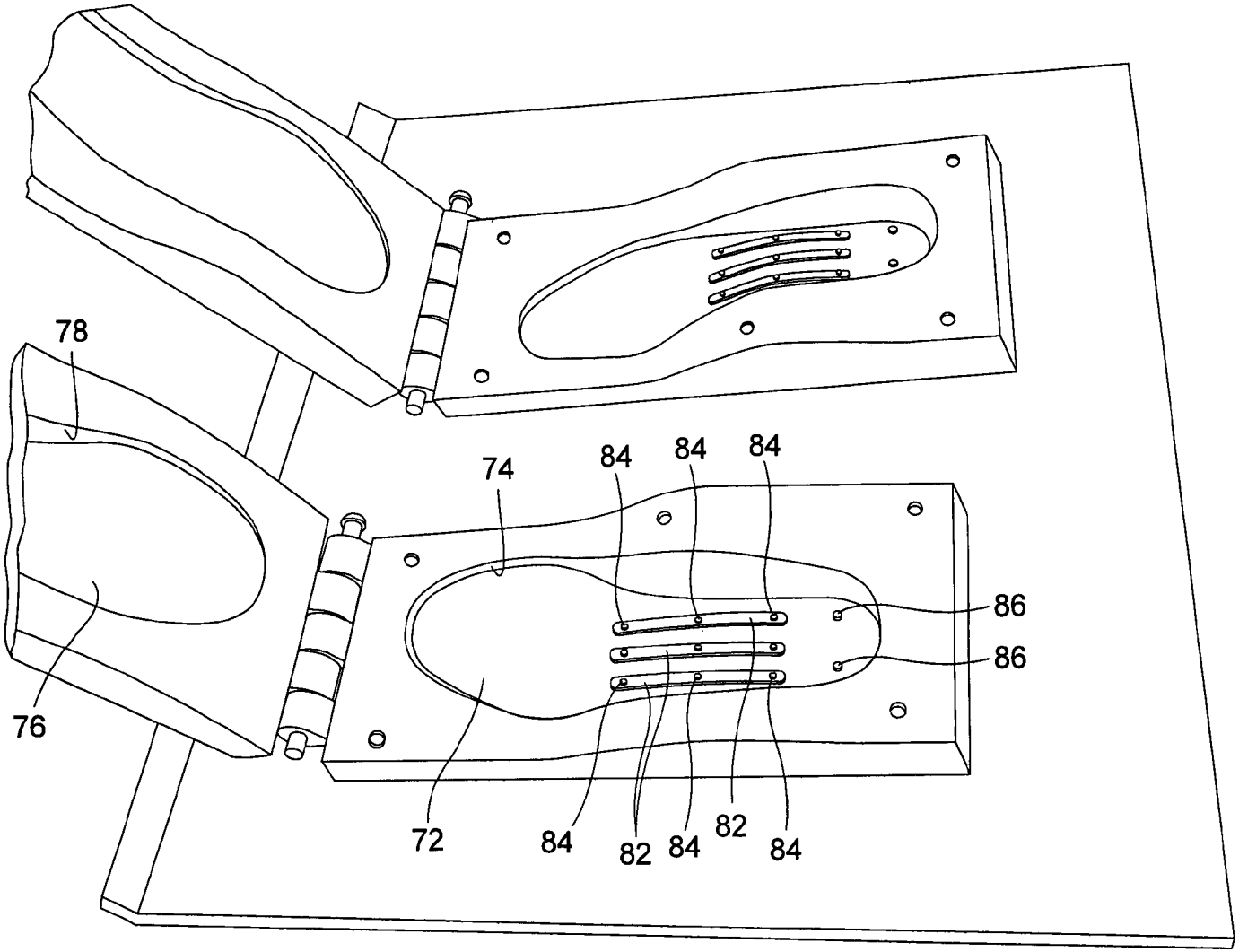
FIG. 12 is a schematic representation of a mold employed in the method of constructing the shoe of the invention.

FIGS. 12-15 schematically illustrate the method steps involved in constructing the shoe of the present invention. FIG. 12 shows a representation of the mold employed in molding the midsole 34 of the shoe. The mold of FIG. 12 shows the molds for the left and right midsoles, and the method of constructing each midsole is substantially the same.

Referring to FIG. 12, the midsole mold is constructed with a bottom surface 72 that is surrounded by a bottom peripheral edge portion 74, and a top surface 76 that is surrounded by a top peripheral edge portion 78. The mold bottom surface 72 molds the midsole bottom surface 38, the mold top surface 76 molds the midsole top surface 36, and the bottom and top peripheral edge portions 74, 78 of the mold, mold the peripheral edge 42 of the midsole. The portion of the mold containing the mold top surface 76 is connected by a hinge to the portion of the mold containing the mold bottom surface 72.

A plurality of plate locator projections 82 are provided on the mold bottom surface 72. Each of the plate locator projections 82 has a narrow, elongate configuration and each of the projections 82 extends outwardly a short distance from the mold bottom surface 72.

A plurality of pins 84 project outwardly from each of the plate locator projections 82. An additional pair of locator pins 86 project outwardly from the mold bottom surface 72 adjacent to the plate locator projections 82.

Figure 13:
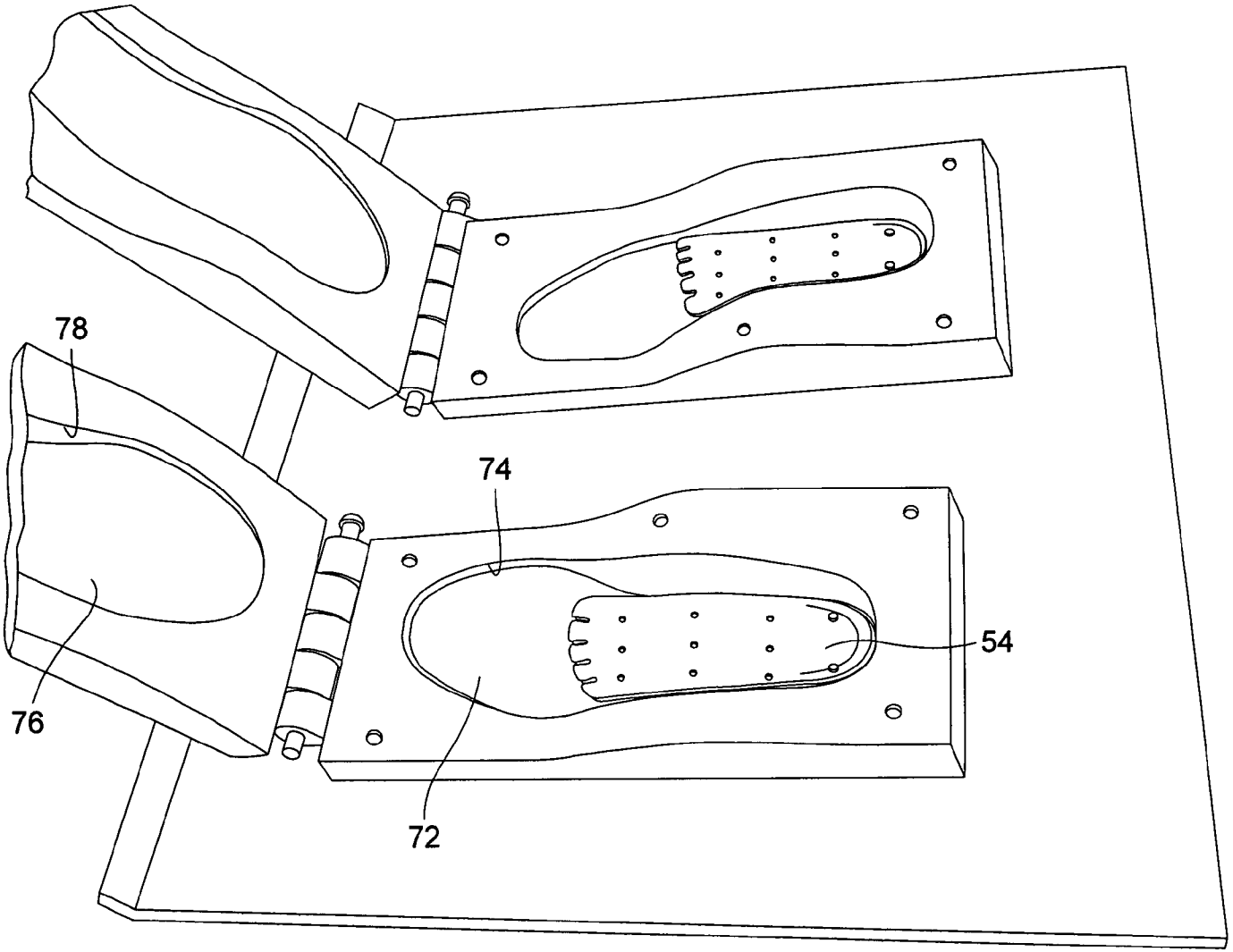
FIG. 13 is a schematic representation of the positioning of the rigid plate in the mold.

FIG. 13 shows the step of positioning the rigid plate 54 in the mold. The rigid plate 54 is positioned over the mold bottom surface 72 on top of the plate locator projections 82. The pins 84 on the plate locator projections 82 and the pins 86 on the mold bottom surface 72 are engaged in the pin holes 68 of the rigid plate 54. The pins 84, 86 thereby positively position the rigid plate 54 over the mold bottom surface 72 on top of the plate locator projections 82. The positive positioning of the rigid plate 54 over the mold bottom surface 72 positions the plate 54 in an area where the material of the midsole will flow over the plate top surface 56 and beneath the plate bottom surface 58.

Figure 14:
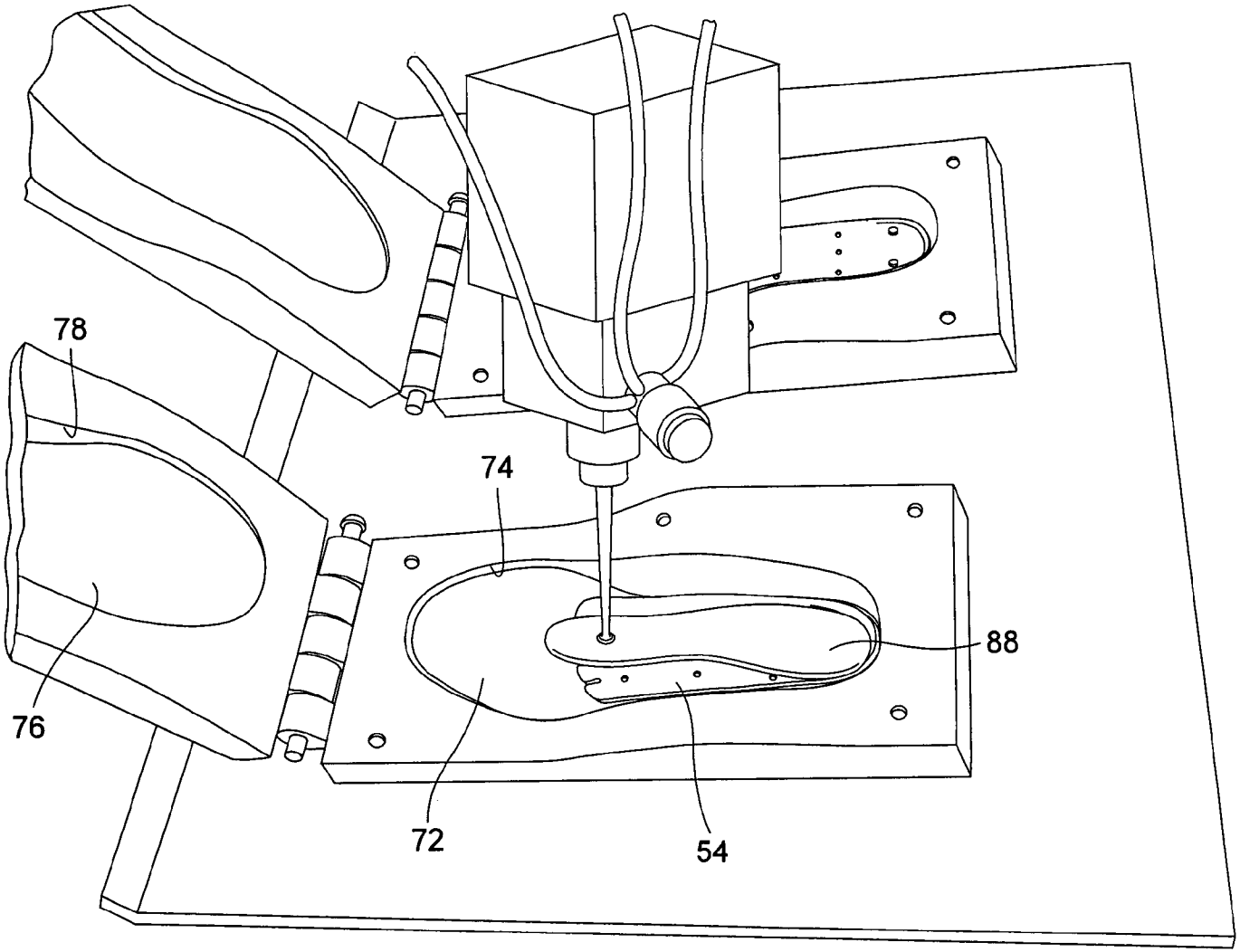
FIG. 14 is a schematic representation of providing the midsole material to the mold; and, FIG. 15 is a perspective view of the completed construction of the shoe of the invention.

FIG. 14 shows the midsole material being added to the mold on top of the plate 54 and on top of the mold bottom surface 72. The plate locator projections 82 that position the rigid plate 54 above the mold bottom surface 72 allow the midsole material 88 to flow beneath the plate 54 and over the plate. This positions the rigid plate 54 inside the material of the midsole. The pins 84, 86 positively locate the plate 54 in its desired position over the mold bottom surface 72 and prevent movement of the plate as the midsole material 88 is added into the mold.

The midsole material 88 is added to the mold completely covering over the mold bottom surface 72 within the mold bottom peripheral edge portion 74. The portion of the mold containing the mold top surface 76 is then closed over the mold bottom surface 72, and the material of the midsole 88 is cured, forming the midsole 34 of the invention. The molded midsole 34 is formed with the plate 54 positioned between the midsole top surface 36 and the midsole bottom surface 38 by the plate locator projections 82. The locator holes 44, 46 formed in the midsole bottom surface 38 are formed by the plate locator projections 82 and pins 84, and the additional pair of pins 86, respectively.

The formed midsole 34 is removed from the mold and is inserted in the opening 28 in the shoe upper 24, positioning the midsole bottom surface 38 on the outsole top surface 16 in combining the two subassemblies of the shoe as shown in FIG. 15.

The simplified construction of the shoe described above provides an inexpensively constructed shoe that is lightweight and comfortable to wear and provides cushioning and support for the shoe wearer's foot.

The invention claimed is:

1. A shoe comprising:

an outsole having opposite top and bottom surfaces and a peripheral edge that extends around the outsole and separates the top surface from the bottom surface, the outsole bottom surface being a tread surface;

an upper of flexible material that is connected to the outsole and extends over the outsole top surface enclosing an interior volume of the shoe, the upper having an opening configured for insertion of a foot through the opening and into the shoe interior volume;

a resilient midsole having opposite top and bottom surfaces and a peripheral edge that extends around the midsole and separates the midsole top surface from the midsole bottom surface, the midsole bottom surface having a plurality of locator holes that extend into the midsole from the midsole bottom surface and each of the locator holes having an end surface inside the midsole spaced between the midsole top surface and midsole bottom surface; and, a rigid plate in the midsole at a position in the midsole that is spaced from the midsole top surface and the midsole bottom surface, the plate having opposite and top and bottom surfaces and a peripheral edge that extends around the plate and separates the plate top surface from the plate bottom surface, and the plate being positioned adjacent the locator hole end surfaces inside the locator holes.

2. The shoe of claim 1, further comprising:

the plate bottom surface being exposed by the locator holes.

3. The shoe of claim 2, further comprising:

the plate having a uniform thickness between the plate top and bottom surfaces and within the plate peripheral edge.

4. The shoe of claim 2, further comprising:

the plate top surface being curved in two mutually perpendicular directions and the plate bottom surface being curved in two mutually perpendicular directions.

5. The shoe of claim 4, further comprising:

the midsole having a complete length that extends from a heel portion of the midsole, to an arch portion of the midsole, to a ball portion of the midsole, to a toe portion of the midsole; and, the plate having a complete length that extends through the midsole heel portion and through the midsole arch portion but does not extend through the midsole ball portion and the midsole toe portion.

6. The shoe of claim 5, further comprising:

the midsole having a uniform thickness between the midsole top surface and the midsole bottom surface only at the midsole ball portion and the midsole toe portion.

7. The shoe of claim 2, further comprising:

the midsole being constructed of a uniformly flexible and resilient material between the midsole top surface and the midsole bottom surface and within the midsole peripheral edge.

8. The shoe of claim 7, further comprising:

the midsole peripheral edge being configured to coincide with the outsole peripheral edge on the outsole top surface and inside the shoe interior volume.

9. The shoe of claim 2, further comprising:

the plate having a plurality of pin holes in the plate bottom surface and each of the plate pin holes coinciding with and being exposed by a midsole locator hole.

10. The shoe of claim 9, further comprising:

the midsole locator holes being larger than the plate pin holes.

11. The shoe of claim 10, further comprising:

a plurality of the plate pin holes coinciding and being exposed by one of the midsole locator holes.

12. The shoe of claim 1, further comprising:

the upper material being a mesh material.

13. A shoe comprising:

an outsole having opposite top and bottom surfaces and a peripheral edge that extends around the outsole and separates the top surface from the bottom surface, the outsole being constructed of a uniformly flexible and resilient material between the outsole top and bottom surfaces and within the outsole peripheral edge, the outsole bottom surface being a tread surface;

an upper of flexible material that is connected to the outsole and extends over the outsole top surface enclosing an interior volume of the shoe, the upper having an opening configured for insertion of a foot through the opening and into the shoe interior volume;

a midsole having opposite top and bottom surfaces and a peripheral edge that extends around the midsole and separates the midsole top surface from the midsole bottom surface, the midsole being constructed of a uniformly flexible and resilient material between the midsole top surface and the midsole bottom surface and within the midsole peripheral edge, the midsole material being different from the outsole material;

a rigid plate in the midsole at a position in the midsole that is spaced from the midsole top surface and the midsole bottom surface, the plate having opposite top and bottom surfaces and a peripheral edge that extends around the plate and separates the plate top surface from the plate bottom surface, and the plate peripheral edge forming a plurality of adjacent notches at one end of the plate that decrease a rigidity of the plate between the plurality of notches; and, the plate top surface being curved in two mutually perpendicular directions and the plate bottom surface being curved in two mutually perpendicular directions.

14. The shoe of claim 13, further comprising:

the plate having a uniform thickness between the plate top surface and the plate bottom surface and within the plate peripheral edge.

15. The shoe of claim 13, further comprising:

the midsole having a complete length that extends from a heel portion of the midsole, to an arch portion of the midsole, to a ball portion of the midsole, to a toe portion of the midsole; and, the plate having a complete length that extends through the midsole heel portion and through the midsole arch portion but does not extend through the midsole ball portion and the midsole toe portion.

16. The shoe of claim 15, further comprising:

the one end of the plate with the plurality of notches being positioned between the midsole arch portion and the midsole ball portion.

17. The shoe of claim 16, further comprising:

the midsole having a uniform thickness between the midsole top surface and the midsole bottom surface only at the midsole ball portion and the midsole toe portion.

18. The shoe of claim 13, further comprising:

the midsole peripheral edge being configured to coincide with the outsole peripheral edge on the outsole top surface and inside the shoe interior volume.

19. The shoe of claim 13, further comprising:

the midsole material being more flexible and more resilient than the outsole material.

20. The shoe of claim 19, further comprising:

the outsole material being more flexible and more resilient than the plate material.

21. The shoe of claim 13, further comprising:

the upper material being a mesh material.

* * * * *